US005343569A

United States Patent [19]

Asare et al.

[11] Patent Number: 5,343,569

[45] Date of Patent: Sep. 6, 1994

[54] PROTECTIVE HELMET CONTAINING DYE CAPSULES

[76] Inventors: Michael K. Asare; Edna M. Asare, both of 2710 Chameleon Dr., Killeen, Tex. 76542

[21] Appl. No.: 96,902

[22] Filed: Jul. 26, 1993

[51] Int. Cl.[5] ..... A42B 3/00

[52] U.S. Cl. ..... 2/412; 2/411

[58] Field of Search ..... 2/410, 411, 412, 414, 2/415, 413, 422, 424, 2, 425; 273/418; 446/27, 267

[56] References Cited

U.S. PATENT DOCUMENTS

| | | | |
|---|---|---|---|
| 2,250,275 | 7/1941 | Riddell | 2/424 |
| 2,729,024 | 1/1956 | Guttmann | 446/267 |
| 2,908,911 | 10/1959 | Sowle | 2/424 |
| 3,039,108 | 6/1962 | Lohrenz | 2/415 |
| 3,242,500 | 3/1966 | Derr | 2/412 |
| 3,859,666 | 1/1975 | Marietta et al. | 2/412 |
| 3,866,909 | 2/1975 | DeSantis | 2/2 |
| 3,946,441 | 3/1976 | Johnson | 2/412 |
| 4,064,565 | 12/1977 | Griffiths | 2/412 |
| 4,446,576 | 5/1984 | Hisataka | 2/412 |
| 4,663,705 | 5/1987 | Comparetto | 2/413 |

*Primary Examiner*—Clifford D. Crowder
*Assistant Examiner*—Michael A. Neas
*Attorney, Agent, or Firm*—E. Michael Combs

[57] ABSTRACT

A protective helmet, particularly used by children, is provided to include an enclosed, generally cylindrical helmet structure providing a plurality of layers of first and second density polymeric foam respectively, with a chin panel mounted to a first side of the helmet arranged for securement to a second side of the helmet.

2 Claims, 4 Drawing Sheets

PROTECTIVE HELMET CONTAINING DYE CAPSULES

BACKGROUND OF THE INVENTION

1. Field of the Invention

The field of invention relates to helmet construction, and more particularly pertains to a new and improved protective helmet wherein the same is directed to afford the encircling protection of a child's head relative to impact.

2. Description of the Prior Art

Various helmet construction has been utilized throughout the prior art such as indicated in the U.S. Pat. Nos. 5,059,212; 5,040,099; 5,035,009; and wherein the instant invention attempts to overcome deficiencies of the prior art by providing for an encircling protection relative to a child's head, wherein the facial opening of the helmet projects in adjacency to the child's eyes for forehead protection of the child and in this respect, the present invention substantially fulfills this need.

SUMMARY OF THE INVENTION

In view of the foregoing disadvantages inherent in the known types of helmet construction now present in the prior art, the present invention provides a protective helmet wherein the same is arranged to provide for a cylindrical helmet structure affording encircling protection to a child's head in use. As such, the general purpose of the present invention, which will be described subsequently in greater detail, is to provide a new and improved protective helmet which has all the advantages of the prior art protective helmets and none of the disadvantages.

To attain this, the present invention provides a protective helmet particularly used by children, to include an enclosed, generally cylindrical helmet structure providing a plurality of layers of first and second density polymeric foam respectively, with a chin panel mounted to a first side of the helmet arranged for securement to a second side of the helmet.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved protective helmet which has all the advantages of the prior art protective helmet and none of the disadvantages.

It is another object of the present invention to provide a new and improved protective helmet which may be easily and efficiently manufactured and marketed.

It is a further object of the present invention to provide a new and improved protective helmet which is of a durable and reliable construction.

An even further object of the present invention is to provide a new and improved protective helmet which is susceptible of a low cost of manufacture with regard to both materials and labor, and which accordingly is then susceptible of low prices of sale to the consuming public, thereby making such protective helmets economically available to the buying public.

Still yet another object of the present invention is to provide a new and improved protective helmet which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
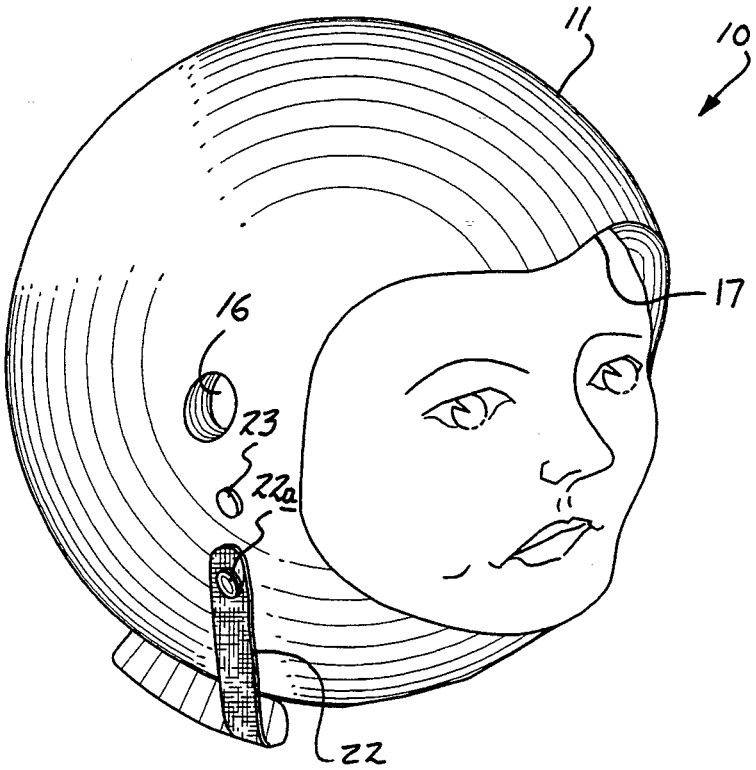
FIG. 1 is an isometric illustration of the invention.
Figure 2:
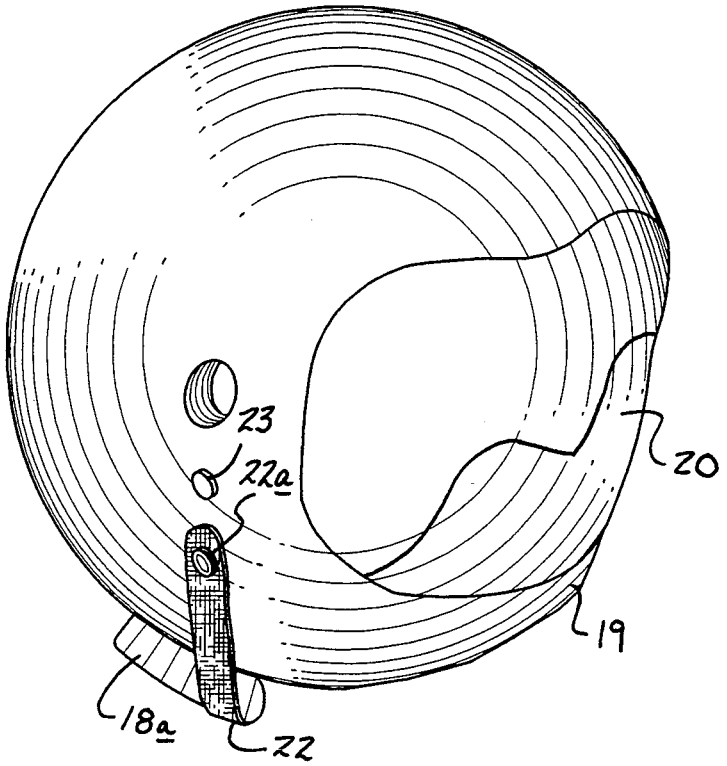
FIG. 2 is an isometric illustration of the invention without the child's head positioned therewithin.
Figure 3:
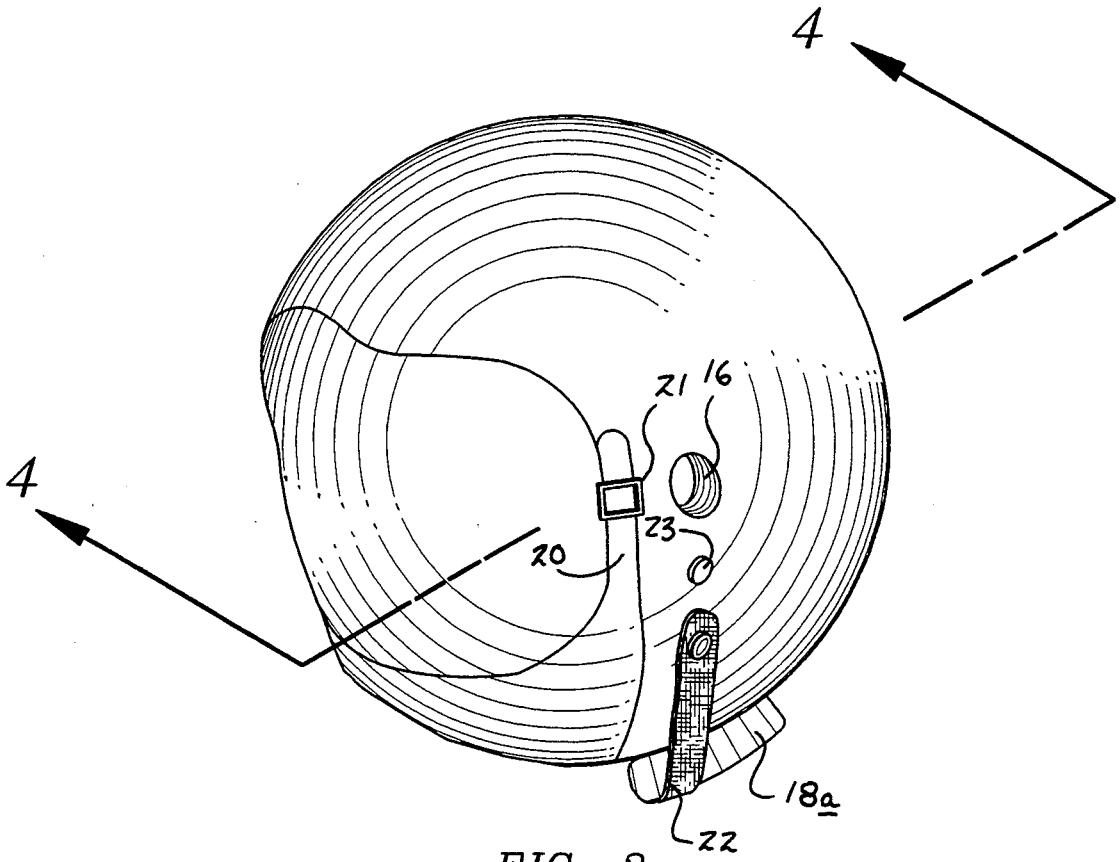
FIG. 3 is a further isometric illustration of the invention of a second side of the helmet structure.
Figure 4:
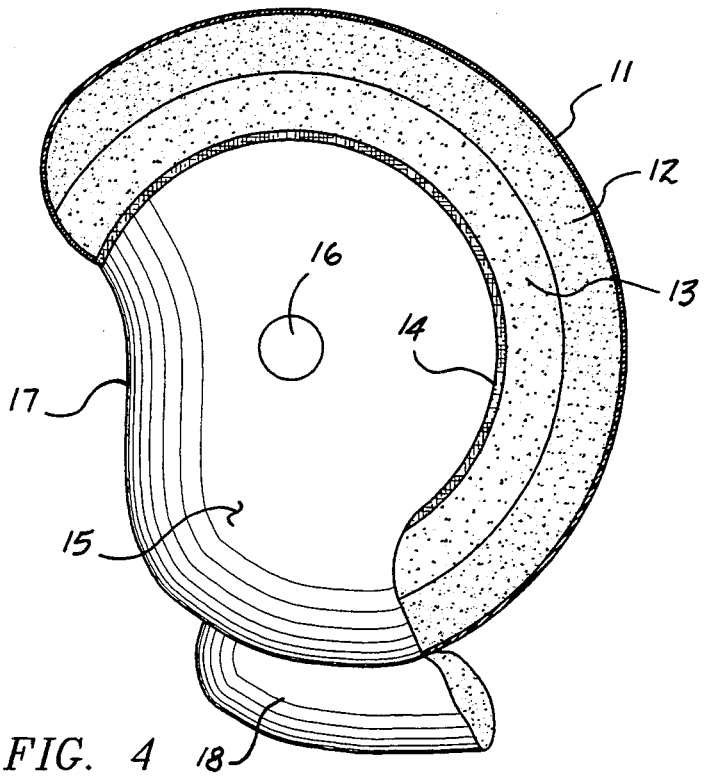
FIG. 4 is an orthographic view, taken along the lines 4—4 of FIG. 3 in the direction indicated by the arrows.

With reference now to the drawings, and in particular to FIGS. 1 to 8 thereof, a new and improved protective helmet embodying the principles and concepts of the present invention and generally designated by the reference numerals 10 and 10*a* will be described.

More specifically, the protective helmet 10 of the instant invention essentially comprises a spherical helmet structure having an outer rigid wall surrounding and coextensive with a polymeric foam low density insulative first layer 12 having a first density, with a polymeric foam high density second layer 13 having a second density greater than said first density, with an inner flexible fibrous web 14 mounted coextensively to the second layer 13 to permit fluid absorption through the fibrous web 14 defining a helmet cavity 15 therewithin to contain an individual's head, such as indicated in FIG. 1. Ear openings 16 are in communication with the helmet cavity 15 through opposed sides of the helmet structure. A facial opening 17 is directed through a forward portion of the helmet, with a neck opening 18 directed through the bottom portion of the helmet, with both the facial and neck openings directed in communication with the helmet cavity 15. The neck opening has formed thereabout an elastomeric skirt 18*a* projecting from the helmet about the neck opening. A chin panel 19 is mounted to a first side of the helmet and secured to a second side of the helmet by a chin panel strap 20 to a buckle 21. A reinforcing strap 22 is arranged for securement over the chin panel 19, with the reinforcing strap 22 having at each ends first connectors 22*a* arranged securably to second connectors 23 mounted to opposed sides of the helmet adjacent an individual ear opening 16. The use of a visor 25 is provided, as illustrated in the FIGS. 7 and 8, having visor connectors 24 pivotally mounting the visor to opposed sides of the helmet adjacent opposed sides of the facial opening 17.

Figure 5:
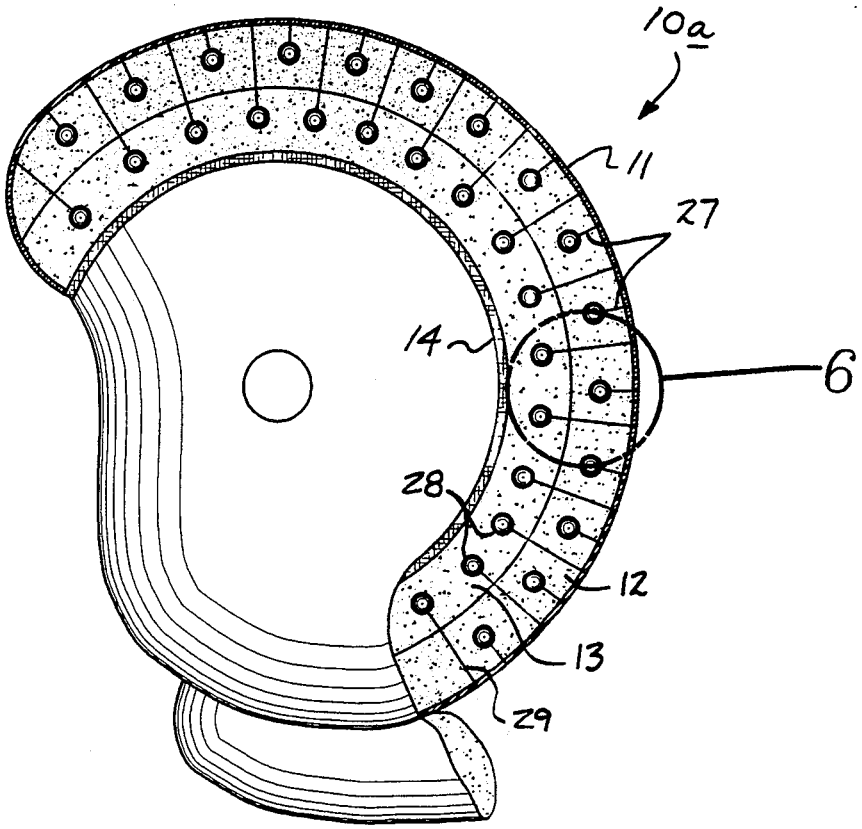
FIG. 5 is an isometric illustration of a modified helmet structure.
Figure 6:
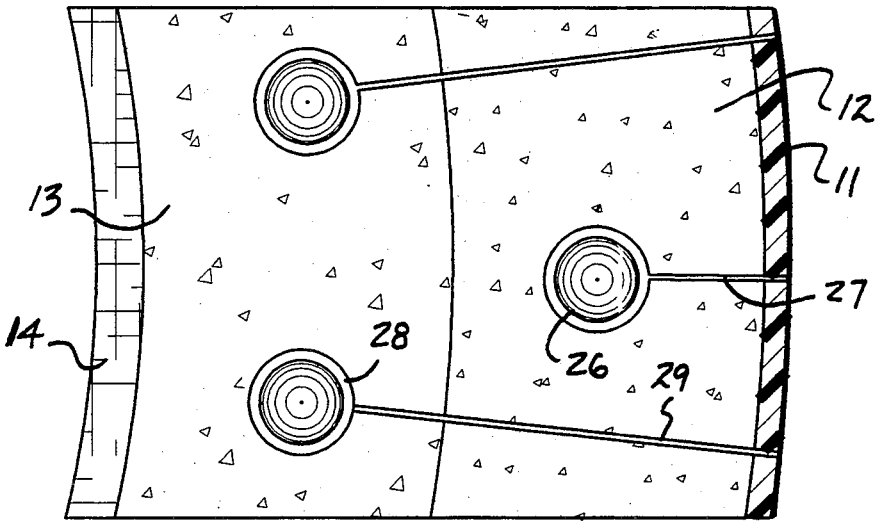
FIG. 6 is an enlarged orthographic view of section 6, set forth in FIG. 5.
Figure 7:
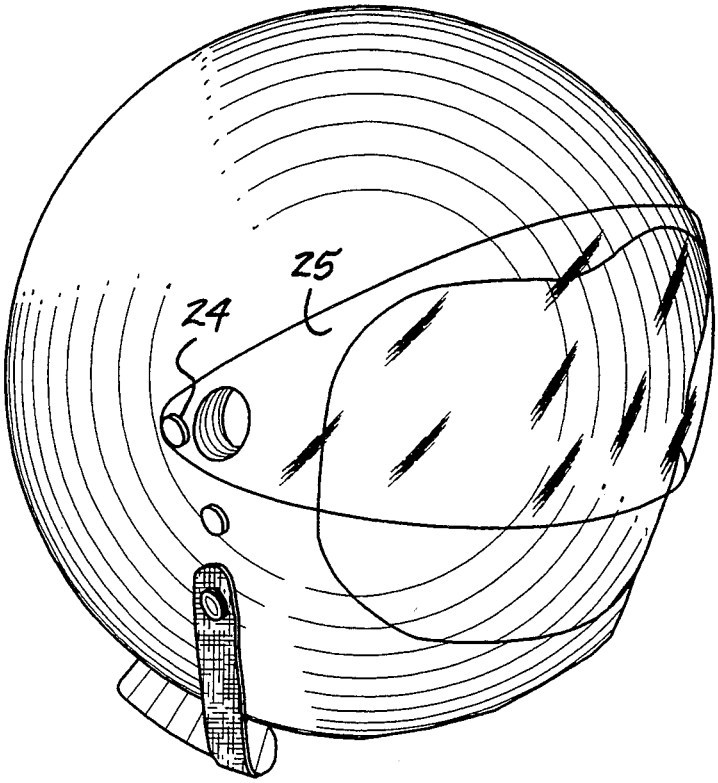
FIG. 7 is an isometric illustration of the invention employing a visor.
Figure 8:
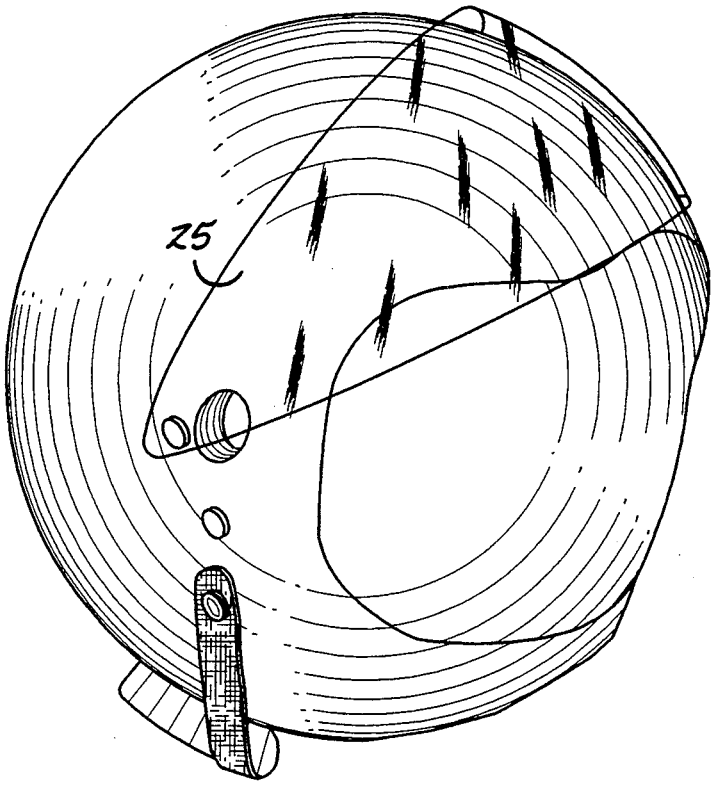
FIG. 8 is an isometric illustration of the invention with the visor lifted relative to the facial opening.

The FIGS. 5 and 6 includes a helmet structure 10*a* to include a matrix of first dye capsules 26 directed throughout the first layer 12, having a first conduit 27 directed into each of the dye capsules 26 in communication through the rigid wall. 11, such that impact to individual portions of the helmet indicated to note such impact whereupon second dye capsules 28 directed coextensively throughout the second layer 13 include a second conduit 29 directed through the outer wall 11 to note discrete impact locations as well as the extent of impact, such that upon impact to the first and second dye capsules 26 and 28 relative to a discrete area of the helmet provides an indicator of impact relative to the helmet structure for purposes of evidence and the like .

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A protective helmet, comprising, a helmet body, having a cylindrical configuration including an outer rigid wall, with a polymeric foam first layer coextensive within the wall, with the first layer having a first density, and a polymeric foam second layer having a second density less than said first density coextensive with the first layer, and an inner flexible fibrous web mounted to the second layer, with the web positioned about a helmet cavity, with a plurality of ear openings directed through the helmet cavity on opposed sides of the helmet cavity, a facial opening directed through the outer wall in communication with the helmet cavity, with an elastomeric skirt projecting from the outer wall about the neck opening, and a chin panel mounted between the facial opening and the neck opening, with the chin panel selectively mounted relative to the other wall, with the chin panel including a chin panel strap, a buckle mounted to the outer wall for securement to the chin panel strap, and a reinforcing strap, having reinforcing strap connectors at opposed distal ends of the reinforcing strap and second connectors mounted to the outer wall, with an individual of said second connectors mounted adjacent to an individual of said ear openings, and the first layer includes a plurality of first dye capsules having a first fluid dye of a layer, and a plurality of first conduits, each of said first conduits in communication with an individual one of said first dye capsules, and each of said first conduits projecting through the outer wall.

2. A protective helmet as set forth in claim 1 including a plurality of second dye capsules directed throughout the second layer, and a plurality of second conduits, with each of said second conduits in communication with an individual one of said second dye capsules, and each of said second conduits extending through the outer wall.

* * * * *